United States Patent [19]

Guzzetta et al.

[11] Patent Number: 5,015,341

[45] Date of Patent: May 14, 1991

[54] INDUCTION GALVANNEALED ELECTROPLATED STEEL STRIP

[75] Inventors: Franklin H. Guzzetta; Alan F. Gibson, both of Middletown; David S. Mitch, Fairfield, all of Ohio

[73] Assignee: Armco Steel Company, L.P., Middletown, Ohio

[21] Appl. No.: 228,645

[22] Filed: Aug. 5, 1988

[51] Int. Cl.[5] ..... C25D 5/50

[52] U.S. Cl. ..... 204/28; 148/127; 148/154; 204/35.1; 204/37.1

[58] Field of Search ..... 204/28, 35.1, 37.1; 148/127, 154; 428/659

[56] References Cited

U.S. PATENT DOCUMENTS

| | | | |
|---|---|---|---|
| 3,056,694 | 10/1962 | Mehler et al. | 117/114 |
| 3,144,364 | 8/1964 | Robinson et al. | 148/113 |
| 3,313,907 | 11/1967 | Geisel et al. | 219/10.61 |
| 3,322,558 | 12/1967 | Turner, Jr. | 117/46 |
| 3,481,841 | 2/1969 | Ham et al. | 204/321 |
| 3,932,205 | 1/1976 | Lindholm et al. | 148/108 |
| 4,252,866 | 2/1981 | Matsudo et al. | 428/659 |
| 4,350,540 | 9/1982 | Allegra et al. | 148/31.5 |
| 4,541,903 | 9/1985 | Kyono et al. | 204/28 |
| 4,726,208 | 4/1988 | Saunders | 72/47 |
| 4,845,332 | 4/1989 | Jancosek et al. | 219/10.77 |
| 4,913,746 | 4/1990 | Marder et al. | 148/127 |

FOREIGN PATENT DOCUMENTS

| | | |
|---|---|---|
| 57-19393 | 2/1982 | Japan . |
| 57-89494 | 6/1982 | Japan . |
| 164998 | 10/1982 | Japan . |
| 9163 | 1/1984 | Japan . |
| 59-200791 | 11/1984 | Japan . |
| 152662 | 9/1985 | Japan . |

OTHER PUBLICATIONS

Metal Finishing Guidebook and Directory for 1975, Metals and Plastics Publications, Inc., Hackensack, N.J., pp. 531, 536-537.

N.V. Ross et al., "Induction Heating of Strip for Galvanneal", 1987, AISE Pittsburg Conference.

"Corrosion Behavior of Painted Zinc & Zinc Alloy Coated Autobody Sheet Steels", SAE No. 860269.

J. Mackowiak et al., "Metallurgy of Galvanized Coatings", pp. 1-19, 1979, *International Metals Reviews.*

*Primary Examiner*—John F. Niebling

*Assistant Examiner*—William T. Leader

*Attorney, Agent, or Firm*—R. J. Bunyard; L. A. Fillnow; R. H. Johnson

[57] ABSTRACT

Galvannealed electroplated steel strip. The strip is heated to an alloying temperature of at least about 427° C. using an induction coil operated at a frequency to produce an eddy current penetration depth of one-half the strip thickness. The diffusion temperature and time are controlled to minimize the formation of brittle gamma alloy phases in the zinc/iron alloy coating.

13 Claims, 5 Drawing Sheets

INDUCTION GALVANNEALED ELECTROPLATED STEEL STRIP

BACKGROUND OF THE INVENTION

This invention relates to a galvannealed electroplated steel strip having a ductile zinc/iron alloy coating and a process therefor. More particularly, a zinc electroplated strip is induction heated using low frequencies to interdiffuse zinc and iron to completely convert the zinc coating into an adherent zinc/iron alloy coating. It will be understood by a zinc coating is meant to include zinc and zinc base alloys. By a galvannealed strip is meant the formation of an alloy coating by heating the steel strip to an elevated temperature to allow interdiffusion of zinc from the zinc coating and iron from the base metal of the strip to form phases of zinc and iron other than those of the pure metals.

Converting a zinc coating to a zinc/iron alloy coating gives a steel strip a dull grey appearance rather than the shiny appearance of regular galvanized coating. The alloy coating has better abrasion resistance and a surface which is more suitable for painting. More importantly, increasing the iron content of the coating makes it much more weldable than regular galvanized strip. Accordingly, an iron rich coating or galvannealed steel strip is more acceptable in the automotive market.

It is well known to form a galvannealed steel strip by continuously hot dipping steel strip into a bath of molten zinc. The coating metal may be converted to a zinc-/iron alloy coating by heating the zinc coated strip to an alloying temperature by radiant heating using direct fire burners placed adjacent to the strip or convection heating by heating the strip in a continuous furnace. It is also known to form a galvannealed strip by induction heating a continuously hot dip coated steel strip. Such an alloyed coating usually is given a conversion coating treatment by dipping in a zinc/iron phosphate solution and painted. It is difficult to obtain the necessary surface smoothness required for automotive exposed surfaces by galvannealing a hot dip coated strip.

Another disadvantage of forming a galvannealed strip using the continuous hot dip process is the high alloying temperatures required, e.g.; greater than 510° C. Zinc coating baths contain a small amount of aluminum. The purpose of the aluminum addition is to retard a zinc/iron alloy formation when producing regular (non-alloyed) galvanized strip. The formation of a zinc-/iron alloy layer at the interface between the steel substrate and zinc coating metal may result in poor coating metal adherence if the coated strip is fabricated into parts. Of course, a steel manufacturer generally cannot restrict an aluminum containing zinc coating metal to only regular galvanized strip. The manufacturer normally would have but a single galvanizing line and both type products, i.e., galvannealed and regular coated, would be produced on this hot dipping line.

From the zinc rich end of an iron/zinc equilibrium phase diagram, it is known four zinc alloy phases can form at galvanneal alloying temperatures. These phases are zeta ($\zeta$) having about 7 atomic % iron, delta ($\delta_1$) having about 8–13 atomic % iron, gamma one ($\Gamma_1$) having about 18–24 atomic % iron and gamma ($\Gamma$) having about 27–32 atomic % iron. For an alloyed coating, the amount of the $\zeta$ phase is probably insignificant since its stability range is narrow. Of the three remaining phases, the $\delta_1$ phase is very desirable because it is more ductile than the $\Gamma$ and $\Gamma_1$ phases. The diffusion process proceeds with iron migrating from the surface of the steel strip toward the outer surface of the zinc coating. An iron concentration gradient exists through the zinc coating thickness. Since the zinc coating must be completely alloyed to its outermost surface so that the coating can be welded and painted, it becomes extremely difficult to eliminate or minimize the formation of the brittle $\Gamma$ and $\Gamma_1$ phases at the surface of the steel strip when using long times and/or high annealing temperatures required for galvannealed continuously hot dip coated steep strip.

It has been previously proposed a galvannealed strip can be produced by induction heating a zinc electroplated strip. Japanese published application 59/9163 discloses alloying a one-side zinc electroplated strip by high frequency induction heating. This Japanese application suggests the surface of a zinc coated steel strip can be heated by high frequencies, which provides an improvement in operation control, and the resulting quality is comparable to a product produced with radiant heating using a direct fired furnace.

Magnetic materials such as ferritic carbon steel also can be heated at low frequencies by inducing eddy current into the steel through the action of an external alternating magnetic field. High frequencies, otherwise known as radio frequencies, are generally defined as about 10 kHz to over 27 MHz. Induced eddy currents produced using radio frequencies are concentrated at the surface of the material with the depth of current penetration determined by the magnetic and electrical properties of the steel. This depth or thickness of the so-called "skin effect" can be calculated by the formula $d=5000(p/\mu f)^{\frac{1}{2}}$ where d is the reference depth (cm), p is the specific electrical (or "volume") resistivity of the heated material (ohm-cm), $\mu$ is the relative permeability and f is the frequency of the applied external magnetic field. Of these properties, the permeability will remain relatively unchanged during the heating process. However, the specific resistance increases with temperature by about 0.125 uohm-cm/°C. At a frequency of 100 kHz, the reference depth for a magnetic carbon steel has been determined to be 0.003 cm at about 150° C. and increasing to only 0.006 cm at about 700° C. When the frequency is reduced to low levels, i.e., not greater than 10 kHz, the current penetrates into the steel. Unlike high frequency heating which heats only the surface or skin of the steel, low frequencies heat the steel uniformly and rather homogeneously. The most efficient heating condition is at a low frequency wherein the current penetration depth is one-half the thickness of the material.

Accordingly, there remains a long felt need for an economical process for producing galvannealed strip wherein the coating metal is completely alloyed with iron and the iron concentration is controlled so that the resulting zinc/iron alloy coating is strongly adherent to the steel substrate and will not crack or craze when the steel strip is fabricated. Furthermore, there remains a need for such an alloy coating that provides good conversion coating and an excellent substrate for automotive paint finishing systems.

BRIEF SUMMARY OF THE INVENTION

The invention relates to an electrogalvanized steel strip having a zinc/iron alloy coating layer on at least one side of the strip. The zinc/iron alloy coating has good conversion coating and painting characteristics.

The surface of the steel strip is given a preliminary cleaning treatment to remove dirt, oil film and the like and then electroplated as the cathode with a zinc containing electrolyte. The coated strip is then passed through a low frequency alternating magnetic field to heat the strip to sufficient temperature to completely convert the zinc coating to an adherent zinc/iron alloy coating.

It is a principal object of this invention to produce a galvannealed steel strip having a zinc/iron alloy coating that is adherent, has good conversion coating characteristics and is acceptable for automotive paint systems.

A feature of the invention is to produce a galvannealed electroplated strip using low frequency induction heating to interdiffuse zinc and iron to completely convert the zinc coating into an adherent zinc/iron alloy coating.

Another feature of the invention is to produce a galvannealed differentially electroplated strip using low frequency induction heating to interdiffuse zinc and iron to completely convert the zinc coating on at least one side of the strip into an adherent zinc/iron alloy coating.

Another feature of the invention is to induction heat an electroplated zinc coated steel strip at a temperature and for a time to minimize the formation of zinc gamma alloy phases in the zinc/iron alloy coating.

Another feature of the invention is to induction heat an electroplated zinc coated steel strip using an alternating frequency of 2–10 kHz to a temperature of less than 510° C. so that a zinc/iron alloy coating containing mostly zinc delta alloy phase is formed.

Another feature of the invention is to treat a galvannealed electroplated strip having a zinc/iron alloy coating formed by induction heating by removing a zinc oxide layer on the outer surface of the alloy coating so that the alloy coating provides good conversion coating and an excellent surface for painting.

Another feature of the invention is a deep drawing galvannealed strip having an adherent zinc/iron alloy coating produced by low frequency induction heating of a zinc electroplated steel strip.

Advantages of the invention include a zinc/iron alloy coating having excellent welding, appearance, painting characteristics and can be produced at a low cost.

The above and other objects, features and advantages of this invention will become apparent upon consideration of the detailed description and appended drawings.

DETAILED DESCRIPTION OF THE PREFERRED EMBODIMENT

Figure 1:
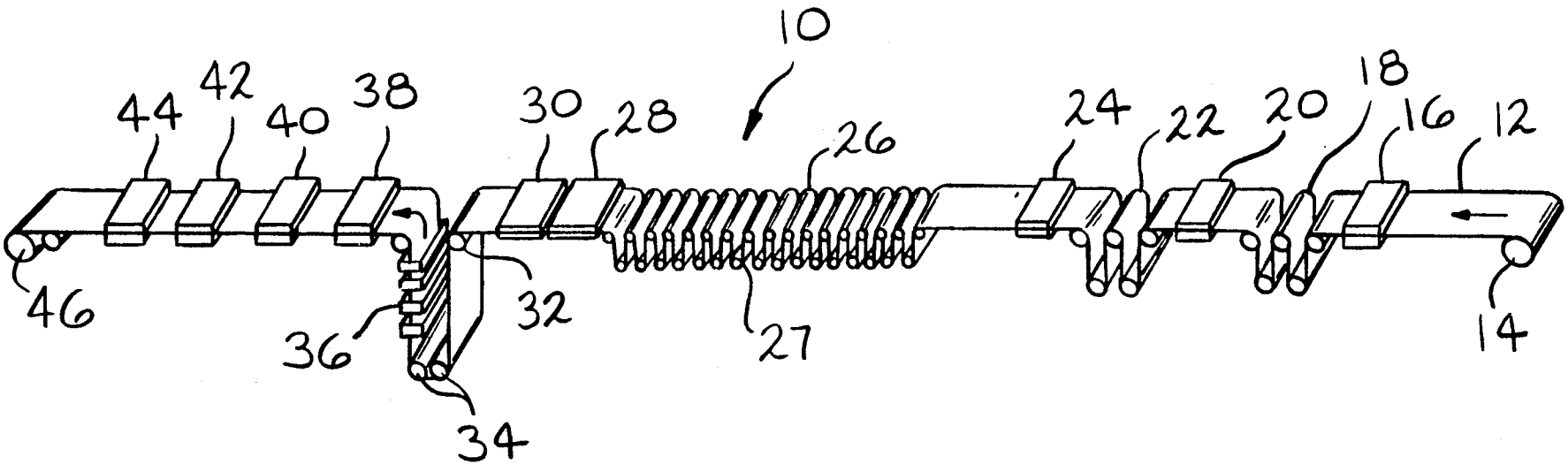
FIG. 1 is a schematic view of a steel strip being processed through a conventional electrogalvanizing line incorporating our invention.

Referring now to FIG. 1, reference numeral 10 shows a schematic of an electrogalvanizing line incorporating the invention. A steel strip 12 is uncoiled from a mandrel 14 and passes successively through a spray cleaner 16, an electrolytic cleaner 18, a rinsing station 20, a strip surface activation treatment 22 and a rinse station 24. Strip 12, normally cold reduced, annealed and skin passed, is cleaned to remove dirt, oil and the like. Strip 12 is then plated on one or both sides by any one of several well known types of vertical or horizontal electroplating devices. One such device is an ARUS-Andritz-Ruther Gravitel plating unit 26 having sixteen vertical plating cells 27. A line speed up to 300 ft/min (91 m/min) for a strip width up to 75 inch (190 cm) can be processed. Typical strip thicknesses for galvanneal applications are 0.024–0.060 inch (0.6–1.5 mm). After electroplating, strip 12 passes through a rinse station 28, is dried by a heater 30, passes around change of direction rollers 32, 34 and vertically passes through a longitudinal induction coil 36. Of course, it will be understood a transverse flux coil could also be used to induction heat strip 12 instead of longitudinal flux coil 36. After the zinc coating has been completely converted to a zinc/iron alloy, strip 12 passes through a quench tank 38 to preserve the $\delta_1$ alloy phase and minimize growth of the $\Gamma$ and $\Gamma_1$ alloy phases. By a zinc/iron alloy coating is meant an alloy coating containing at least about 7 atomic % iron. Preferably, strip 12 will be given further treatments to enhance the painting characteristics of the zinc/iron alloy coating. As shown in FIG. 1, any surface contamination such as zinc oxide formed on the surface of the zinc/iron alloy coating can be removed by passing strip 12 through an acid in tank 40. The treated galvannealed strip may be further treated by passing through a conversion coating station 42, dyed by a heater 44 and coiled on a mandrel 46.

For longitudinal flux induction heating, optimum frequency for the most efficient power consumption is inversely related to strip thickness and ideally produces a current penetration depth of about one-half the strip thickness. For cold rolled electroplated steel, we have determined a low frequency up to about 10 kHz for a strip thickness range of about 0.024–0.060 inches (0.6–1.5 mm) can be used without degrading the overall performance of the process significantly.

It will be understood a variety of zinc, zinc alloy or composite coatings are possible. For example, a different number of plating anodes in plating unit 26 could be used on opposite sides of the strip to form differential weight coatings. For a differential weight zinc electroplated strip, it may be necessary to completely convert the zinc coating to a zinc/iron alloy coating only on the one side of the strip having the lower weight coating (less thickness) when only that side is to be painted or welded. One or more alloying elements of nickel, cobalt, manganese, iron and the like could be dissolved into the zinc containing electrolytic plating solution.

By way of a non-limiting example, a 0.79 mm thick by 254 mm wide strip was plated with a pure zinc differential coating having a thickness of about 10 $\mu$m (60 gm/m$^2$) on one side and a thickness of about 6 $\mu$m (35 gm/m$^2$) on the other side. The strip then was passed through a solenoid induction coil having eight full turns with about 10 mm spacing between each turn. The processing parameters and temperature of the strip surface as measured by a contact pyrometer are shown in Table I.

TABLE I

| Sample | Line Speed (m/min) | Power kW | Frequency (kHz) | °F. (°C.) Strip Temperature | |
|---|---|---|---|---|---|
| 1 | 6.1 | 62 | 6.3 | 960 | (516) |
| 2 | 6.1 | 61 | 6.3 | 960 | (516) |
| 3 | 6.1 | 60 | 6.3 | 960 | (516) |
| 4 | 6.1 | 60 | 6.3 | — | — |
| 5 | 6.1 | 58 | 6.3 | 930 | (499) |
| 6 | 6.1 | 57 | 6.3 | 930 | (499) |
| 7 | 6.1 | 56 | 6.3 | 910 | (488) |
| 8 | 6.1 | 55 | 6.2 | 890 | (477) |
| 9 | 6.1 | 52 | 6.2 | 870 | (466) |
| 10 | 6.1 | 51 | 6.2 | 855 | (457) |
| 11 | 6.5 | 50 | 6.1 | 830 | (433) |
| 12 | 6.5 | 48 | 6.1 | 830 | (443) |
| 13 | 6.5 | 47 | 6.1 | 815 | (435) |
| 14 | 6.5 | 46 | 6.1 | 800 | (427) |
| 15 | 6.5 | 44 | 6.1 | 780 | (416) |
| 16 | 6.5 | 43 | 6.1 | 720 | (382) |
| 17 | 6.5 | 42 | 6.0 | 680 | (360) |
| 18 | 6.5 | 40 | 6.0 | 660 | (349) |
| 19 | 6.5 | 39 | 5.9 | 620 | (327) |
| 20 | 6.5 | 38 | 5.8 | 620 | (327) |
| 21 | 6.5 | 0 | 0 | ambient | |

Figure 2:
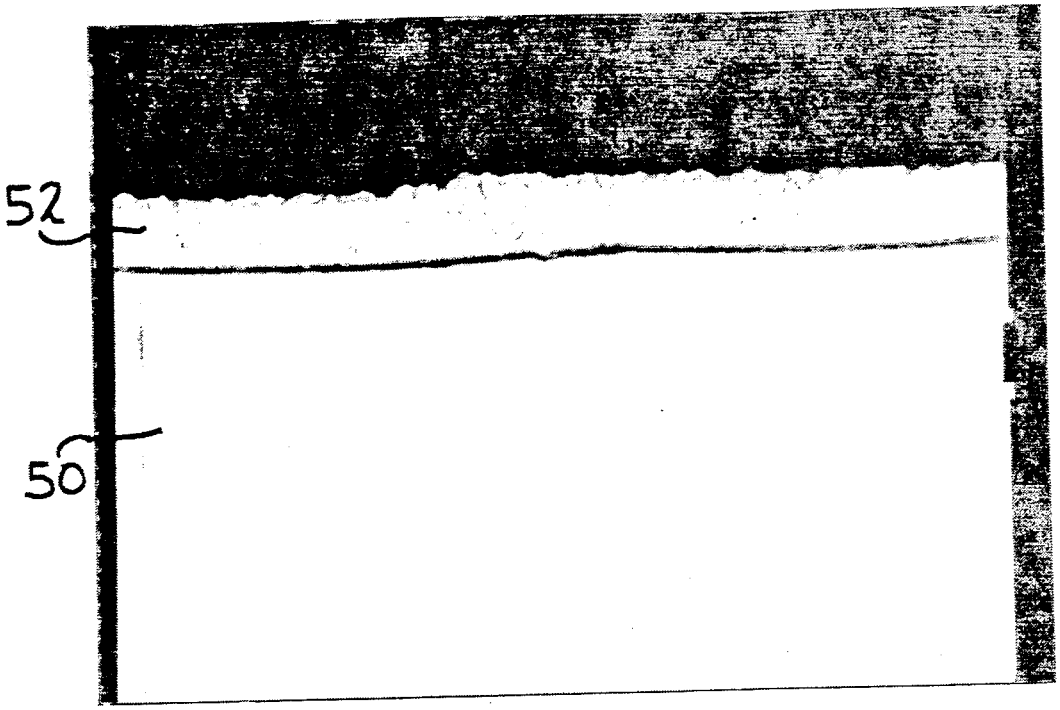
FIG. 2 shows a section view of a zinc electroplated coating on a steel strip.
Figure 3:
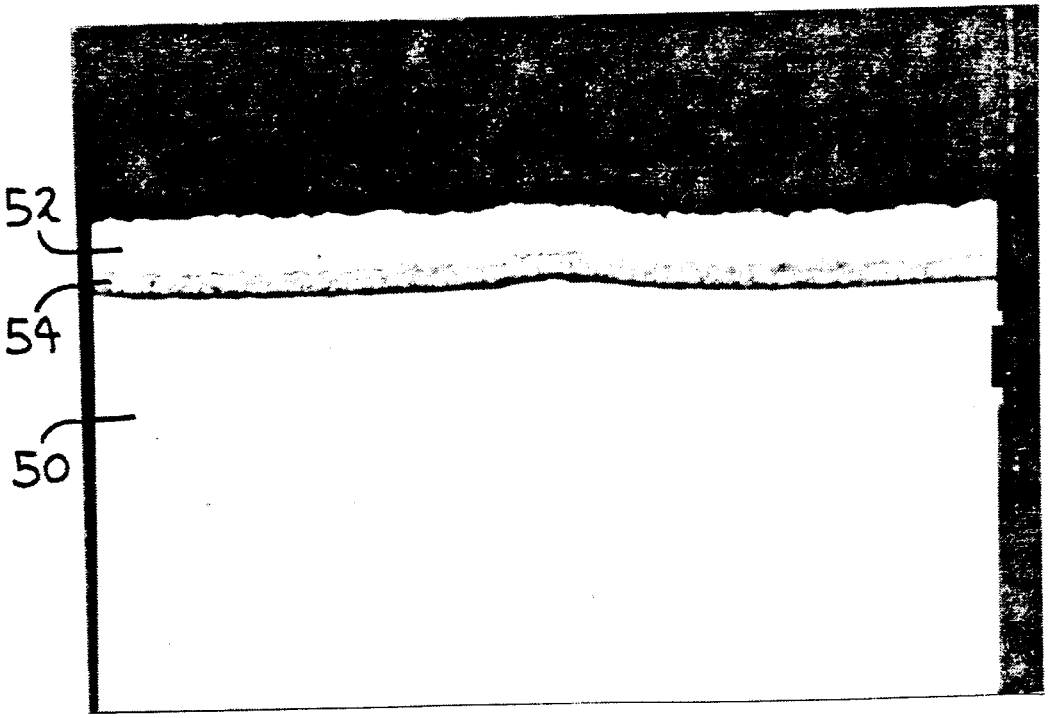
FIGS. 3–5 show section views of the zinc coating of FIG. 2 with increasing amounts of a zinc/iron alloy layer as the electroplated steel strip is induction heated to higher alloying temperatures.
Figure 4:
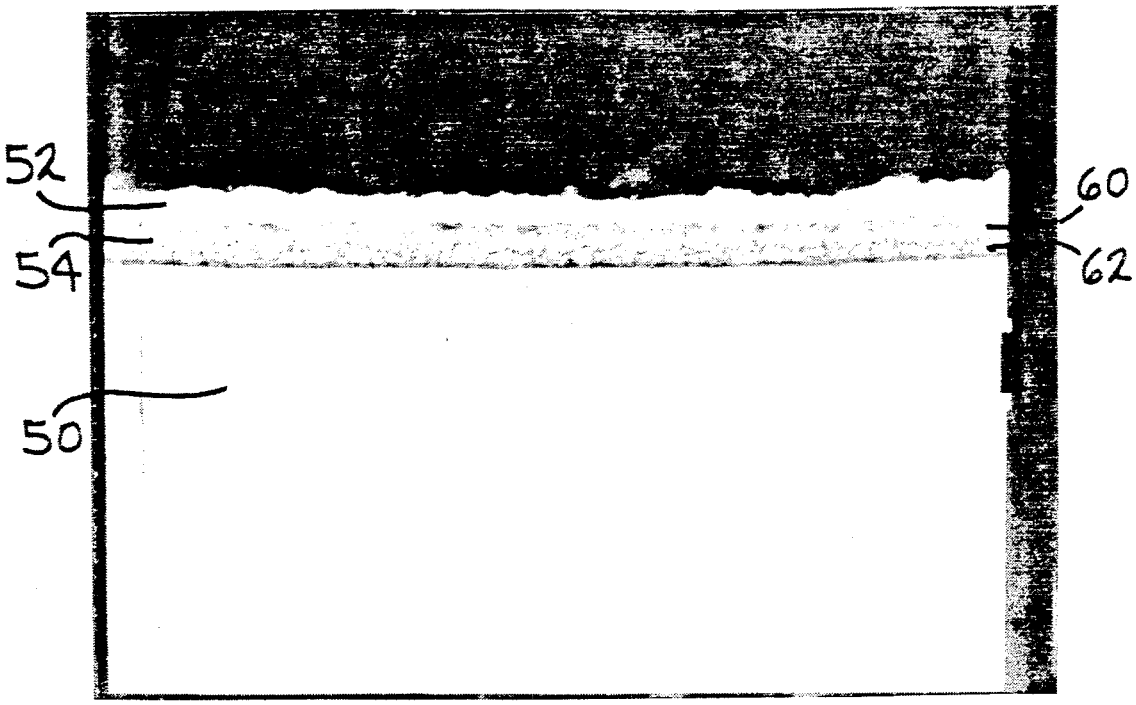
Figure 5:
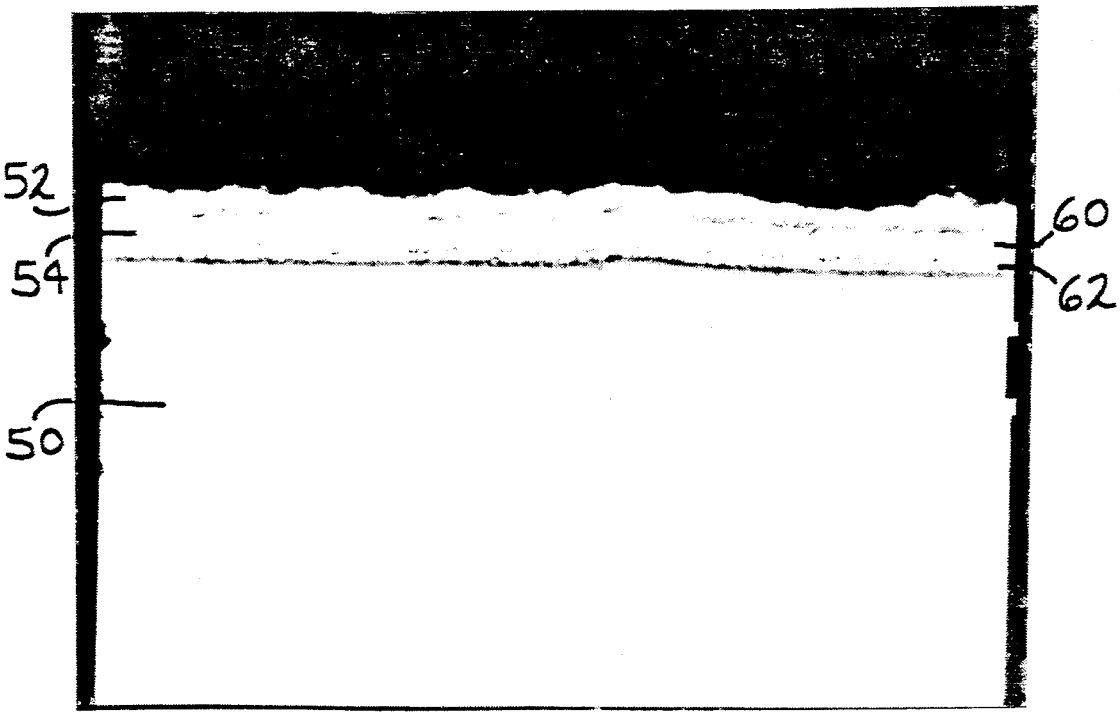
Figure 6:
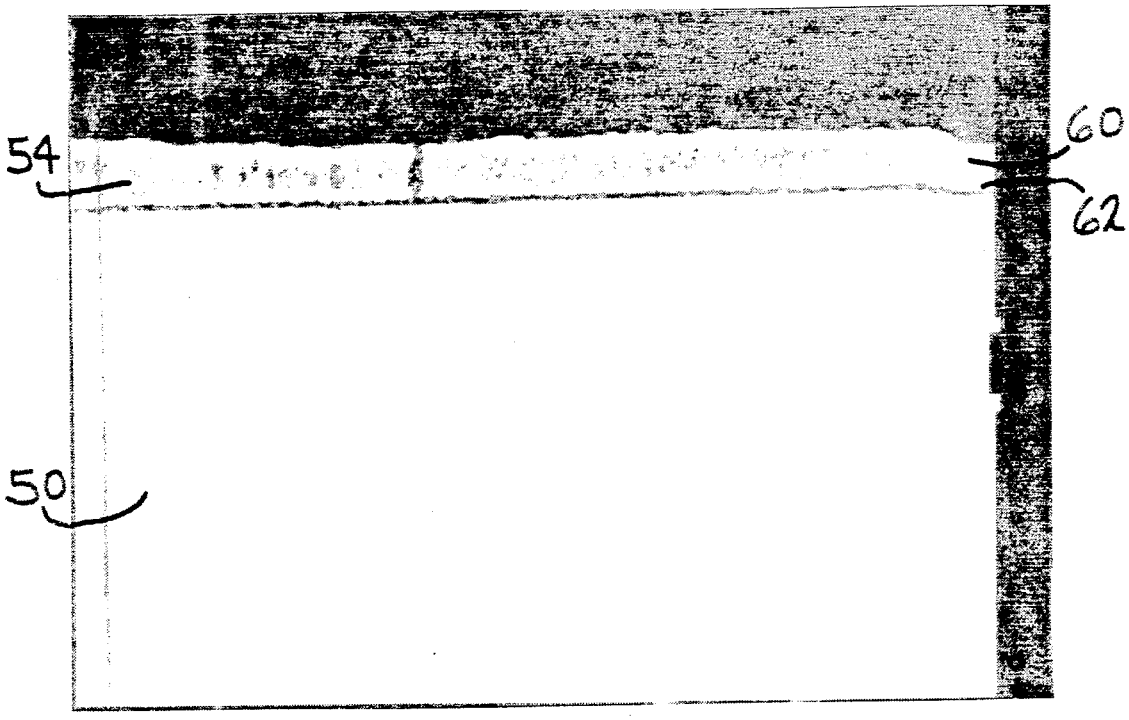
FIG. 6 shows a section view of the zinc coating of FIG. 2 having been completely converted to the zinc/iron alloy coating.
Figure 7:
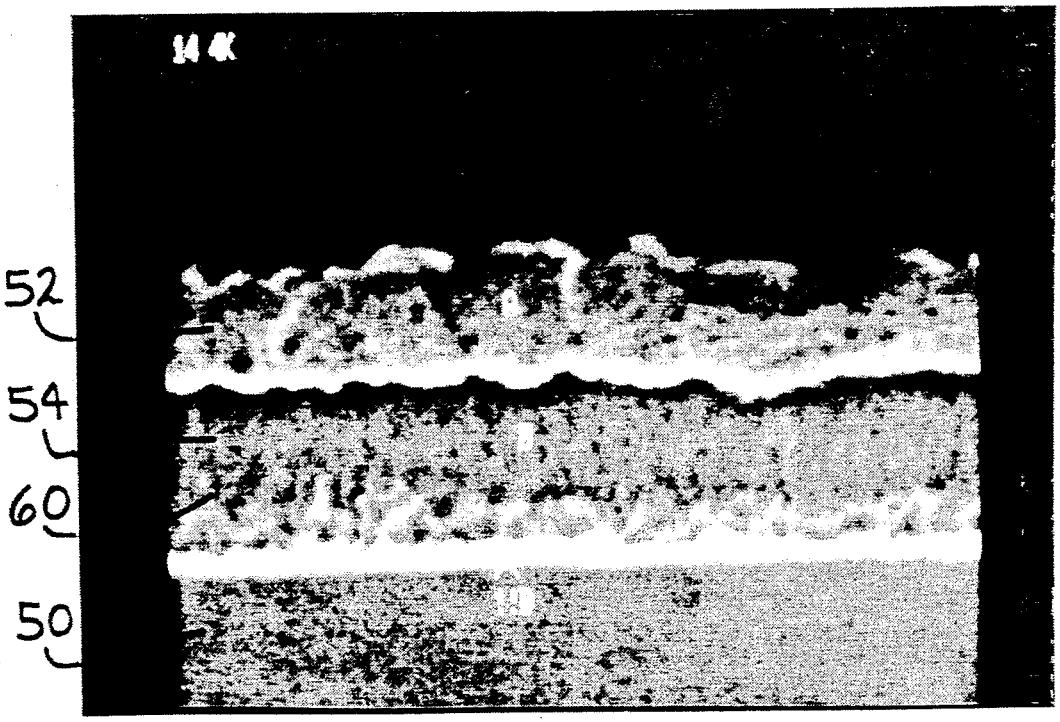
FIG. 7 shows a section view at higher magnification of the coating of FIG. 5, FIGS. 8–9 are section views at higher magnification showing zinc coatings completely converted to zinc/iron alloy coatings.
Figure 8:
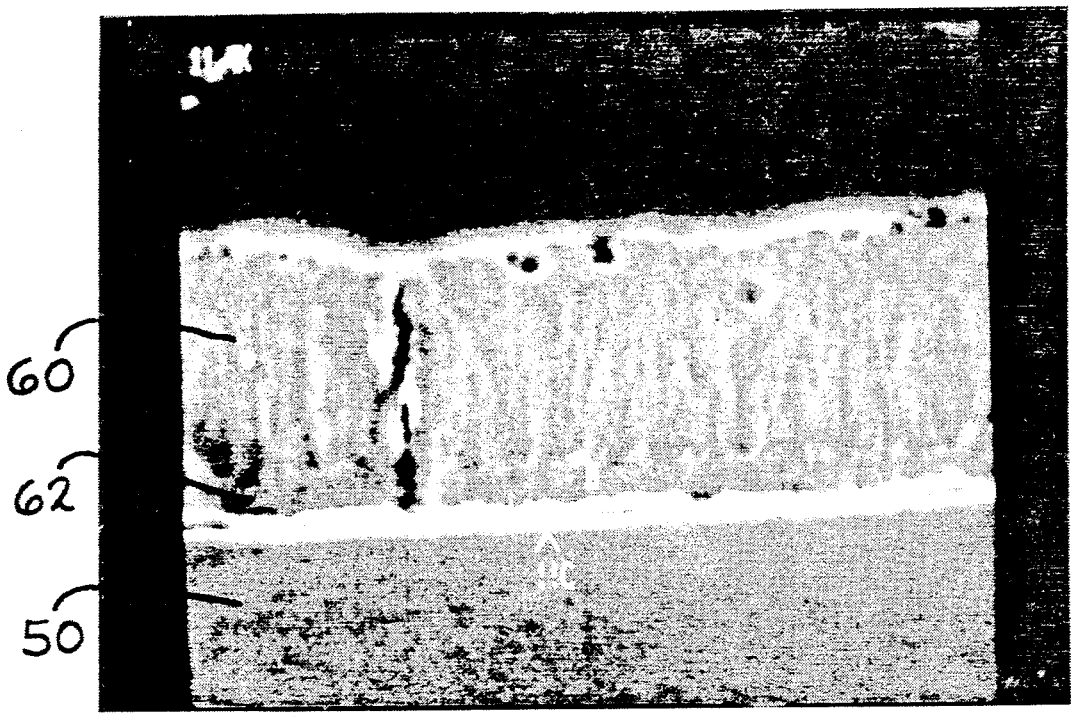
Figure 9:
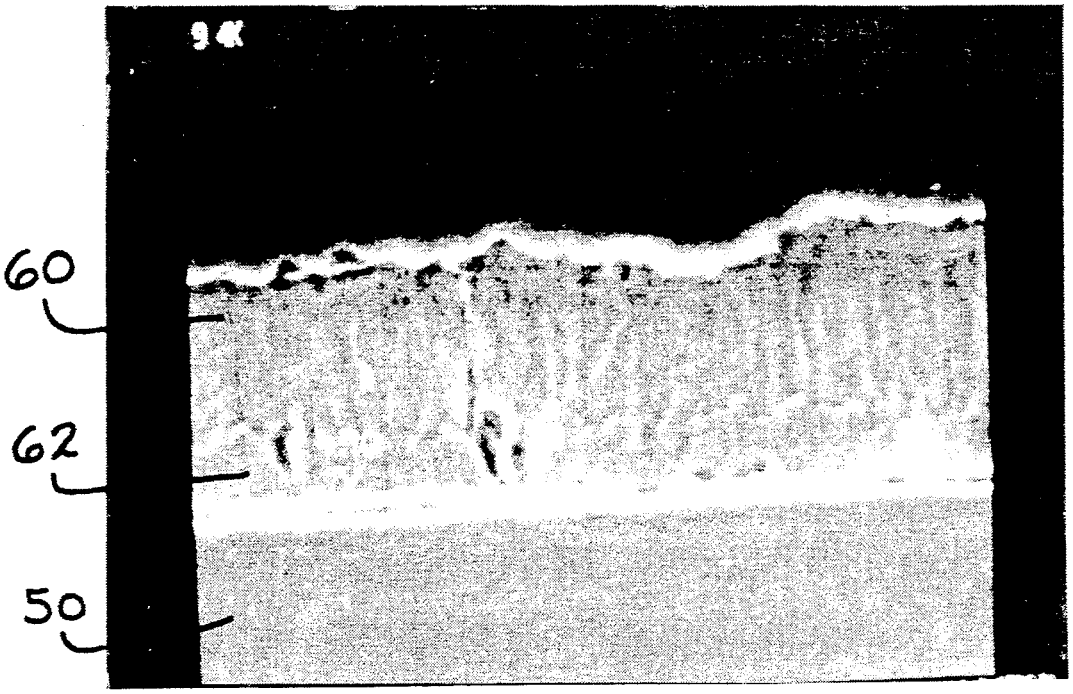

After the zinc coating on strip 12 was heated by coil 36, strip 12 was quenched in water in tank 38 to a temperature below about 400° F. (204° C.) to prevent further diffusion of iron from the steel base metal into the zinc/iron alloy coating. FIGS. 2–6 are photographs taken at 1000× magnification through the zinc coating of samples 21, 18, 15, 14 and 13 respectively. FIG. 2 shows a substrate 50 of strip 12 having a pure zinc coating 52 prior to induction coil 36 being used to heat strip 12. FIG. 3 shows a zinc/iron alloy layer 54 starting to grow between steel substrate 50 and pure zinc coating layer 52 at a strip temperature of 349° C. FIG. 4 shows that alloy layer 54 has progressed through over half the thickness of the coating when heated to 416° C. FIG. 5 shows that alloy layer 54 has grown nearly through the coating thickness with only a small thickness of zinc coating layer 52 remaining when strip 12 was heated to 427° C. Finally, FIG. 6 shows that iron from substrate 50 has interdiffused through the entire thickness of the zinc coating and the zinc coating has become substantially converted to zinc/iron alloy coating 54 when the strip was heated to 435° C. It should also be noted zinc/iron alloy coating 54 in FIGS. 4–6 has a relatively thick outer layer 60 believed to be predominantly delta-one-palisades ($\delta_1$p) alloy phase and a thinner inner layer 62 believed to be predominantly delta-one-compact ($\delta_1$k) alloy phase adjacent to steel substrate 50. FIG. 6 illustrates a preferred embodiment of the invention wherein the zinc coating is completely alloyed to zinc/iron with minimal formation of brittle gamma alloy phases. FIGS. 7–9 are photographs taken at 4000× magnification of samples 14, 11 and 9 respectively. Letters A and B identify approximate sites at which spectrographic chemical analysis using an electron microprobe was used. Approximate chemical analyses of the zinc and alloy phases are shown in Table II.

TABLE II

| Sample # | Site | Iron (atom %) | Zinc (atom %) |
|---|---|---|---|
| 14 | FIG. 7A | 2 | 96 |
| 14 | FIG. 7B | 8 | 90 |
| 11 | FIG. 8A | 10 | 89 |
| 11 | FIG. 8B | 20 | 79 |
| 9 | FIG. 9A | 9 | 91 |

TABLE II-continued

| Sample # | Site | Iron (atom %) | Zinc (atom %) |
|---|---|---|---|
| 9 | FIG. 9B | 15 | 85 |

The analysis for sample 14 heated to 427° C. and quenched after 30 seconds shows zinc layer 52 (site A) in FIG. 7 had an iron concentration of about 2 atomic % while adjacent inner alloy layer 54 (site B) had an iron concentration of about 8 atomic %. From the iron/zinc equilibrium phase diagram, it is known the $\zeta$ alloy phase contains about 7 atomic % iron and $\delta_1$ alloy phase contains about 8–13 atomic % iron. The alloying time and temperature for this sample was insufficient to completely convert the entire thickness of zinc coating 52 to an alloy having at least about 7 atomic % iron.

Analysis for sample 11 (FIG. 8) after heating to 443° C. and quenched 30 seconds after the coating layer was completely converted to a zinc/iron alloy determined outer layer 60 (site A) to have an iron concentration of about 10 atomic % while thin inner layer 62 (site B) had an iron concentration of about 20 atomic %.

Sample 9 (FIG. 9) heated to 466° C. and quenched 30 seconds later showed similar results. Layer 60 (site A) was found to have an iron concentration of about 9 atomic % and layer 62 (site B) to have an iron concentration of about 15 atomic %.

Although the analyses at sites B for samples 9 and 11 were greater than 13 atomic % iron, it is believed layers 62 are predominantly $\delta_1$k alloy phase. The higher than expected analysis is apparently influenced by the adjacent (higher iron content) gamma layers and/or steel substrate. The arrows at sites C in FIGS. 8 and 9 mark what are believed to be a very thin layer containing one or both of the gamma phases between layer 62 and substrate 50.

As demonstrated in FIGS. 5 and 6, the zinc coating becomes completely alloyed at a temperature of about 435° C. It will be understood the alloying temperature could be reduced somewhat if the quench time is delayed longer than 30 seconds i.e. 415° C. Of course, further delaying quenching the heated strip allows additional growth of the inner $\Gamma$ and $\Gamma_1$ alloy phase layers. Such delay is possible if subsequent fabrication required of the galvannealed strip is less severe. A higher alloying temperature is also possible when the fabrication is not critical or quenching occurs sooner i.e. 510° C. Preferably, the alloying temperature and diffusion time prior to quench will be such as to limit the iron concentration in the zinc/iron alloy coating to about 8–13 atomic %. That is to say, it is preferred to limit the zinc/iron alloy coating to $\delta_1$ alloys or minimize the amount of any brittle inner $\Gamma$ or $\Gamma_1$ alloy layers adjacent to the steel substrate so that these brittle layers constitute less than 10% of the total thickness of the alloy coating.

The thicknesses of the zinc coating and/or zinc/iron alloy phase layers on the samples in Table I were measured and the results are shown in Table III.

TABLE III

| Sample # | Strip Temp. (°C.) | Zinc or alloy layer thicknesses ($\beta$m) Zinc | $\delta_1$p | $\delta_1$k | gamma |
|---|---|---|---|---|---|
| 1 | 516 | 0 | 1 | 8 | 1 |
| 2 | 516 | 0 | 1 | 8 | 1 |
| 3 | 516 | 0 | 1 | 8 | 1 |
| 4 | — | 0 | 1 | 8 | 1 |

TABLE III-continued

| Sample # | Strip Temp. (°C.) | Zinc or alloy layer thicknesses (βm) Zinc | $\delta_1p$ | $\delta_1k$ | gamma |
|---|---|---|---|---|---|
| 5 | 499 | 0 | 4 | 5 | 1 |
| 6 | 499 | 0 | 4 | 5 | 1 |
| 7 | 488 | 0 | 5 | 4 | 1 |
| 8 | 477 | 0 | 5 | 4 | 1 |
| 9 | 466 | 0 | 6 | 3 | 1 |
| 10 | 457 | 0 | 7 | 2 | 1 |
| 11 | 443 | 0 | 7 | 2 | <1 |
| 12 | 443 | 0 | 7 | 2 | <1 |
| 13 | 435 | <1 | 7 | 2 | <<1 |
| 14 | 427 | 3 | 6 | 1 | <<1 |
| 15 | 416 | 3 | 6 | 1 | <<1 |
| 16 | 382 | 5 | 5 | 0 | * |
| 17 | 360 | 7 | 3 | 0 | * |
| 18 | 349 | 7 | 3 | 0 | * |
| 19 | 327 | 10 | 0 | 0 | * |
| 20 | 327 | 10 | 0 | 0 | * |
| 21 | ambient | 10 | 0 | 0 | 0 |

*No significant amount of the gamma phases present.

A 60 degree compression sharp angle bend test was also made on several of the galvannealed samples shown in Table III. After each sample was forced into an anvil by the punch, the sample was flattened and taped with a 3M 610 type clear adhesive tape. The total width of the coating transferring to the tape is a measure of coating adhesion. Experience has shown a loss of no greater than about 3 mm is good adherence. From the results which are shown in Table IV, good adhesion was found for galvannealing temperatures up to at least 488° C. Referring back to Table III, it was also observed the thickness of $\delta_1p$ alloy phase exceeded the thickness of $\delta_1k$ alloy phase up to a temperature of 488° C. That is to say, not only should the formation of the gamma alloy phases be prevented or minimized during galvannealing, but also $\delta_1p$ alloy phase is preferred to $\delta_1k$ alloy phase.

TABLE IV

| Sample # | Strip Temp. (°C.) | Adhesion (mm) |
|---|---|---|
| 5 | 499 | 7 |
| 7 | 488 | 3 |
| 9 | 466 | 2 |
| 11 | 443 | 2 |
| 13 | 435 | 2 |
| 15 | 416 | 0 |
| 17 | 360 | 0 |
| 19 | 327 | 0 |

Paintability and corrosion characteristics of galvannealed electroplated samples were evaluated using a well known automotive cleaning, conversion coating and painting practice as disclosed in SAE paper No. 860269, titled "Corrosion Behavior of Painted Zinc and Zinc Alloy Coated Autobody Sheet Steels", incorporated herein by reference. As demonstrated in Table V, galvannealed electroplated samples given the above referenced automotive test procedure did not have good corrosion characteristics. Auger electron analysis of the surface of the zinc/iron alloy coating revealed iron was not present. Rather, the surface was determined to be a thin film of predominantly zinc oxide. Of course, oxides are passive and not readily treated by conversion coatings such as phosphate. It is believed induction heating in air caused oxidation of the zinc coating. It was determined the oxide film could be removed by various chemical treatments. Two chemical found acceptable for this purpose were phosphoric and sulfuric acid wherein the film was removed using a 5 gm/l solution of either acid and rinsing the alloyed strip for 5–10 seconds prior to applying a conversion coating to the alloy coating.

Samples were evaluated according to scab and creepage ratings after using a 30 cycle corrosion test in accordance with the above reference automotive practice with the results shown in Table V.

TABLE V

| Sample # | Strip Temp. (°C.) | Without Acid Rinse Scab | Creepage (mm) | $H_3PO_4$ Rinse Scab | Creepage (mm) | $H_2SO_4$ Rinse Scab | Creepage (mm) |
|---|---|---|---|---|---|---|---|
| 22* | >538 | 7.0 | >.79 | — | — | — | — |
| 23 | 399 | 4.3 | >2.78 | 7.0 | 1.15 | 7.0 | .59 |
| 24 | 427 | 5.3 | 1.39 | 7.3 | .95 | 7.0 | .71 |

*Control sample of galvannealed continuously hot dip zinc coated steel.

From the above results, it can be seen the corrosion properties of galvannealed electroplated samples 23 and 24 that were not acid rinsed prior to the automotive sample preparation treatment were not as good as those for control sample 22. However, when the galvannealed electroplated samples were acid rinsed, the scab and creepage ratings were comparable to those for the control sample.

Galvannealed steel for deep drawing applications normally will be cold reduced, annealed and skin passed prior to electroplating. A galvannealed ferritic steel having interstitial or free carbon has diminished mechanical properties due to carbon aging resulting from heating. For products requiring high formability, we have determined adding at least a stoichiometric amount of any one of well known carbide forming elements to the base metal will prevent or minimize carbon aging. Nonlimiting carbide formers include titanium, niobium and zirconium.

Various modifications can be made to our invention without departing from the spirit and scope of it. For example, strip cleaning may be electrolytic or immersion. The strip may be plated on one or both sides using either horizontal or vertical plating cells. Any number of longitudinal or transverse induction coils may be used depending on generator size and line speeds employed. For galvannealed strip to be painted that is alloyed in air, a mechanical or chemical treatment to remove any oxide from the zinc/iron surface prior to conversion coating may be necessary. Therefore, the limits of our invention should be determined from the appended claims.

We claim:

1. A method of producing a galvannealed steel strip, comprising the steps of:

cleaning a steel strip, electroplating at least one side of the steel strip with a zinc coating, passing said coated strip through an induction coil operating at a frequency less than 10 kHz whereby said coated strip is heated to a temperature no greater than 510° C. to completely convert said zinc coating to a zinc/iron alloy coating by causing iron from the steel strip to diffuse through the entire thickness of said zinc coating, cooling said alloyed strip to substantially stop said diffusion of iron into said zinc/iron alloy coating so that the thickness of any inner layer of zinc alloy gamma phases adjacent to the steel substrate is no greater than about 10% of the total thickness of said zinc/iron alloy coating and the remainder of said zinc/iron alloy coating having no greater than about 13 atomic % iron whereby said zinc/iron alloy coating is ductile and resistant to cracking.

2. The method of claim 1 wherein said strip is heated to a temperature greater than 427° C.

3. The method of claim 1 wherein said induction coil is operated at a frequency to produce an eddy current penetration depth of about one-half the thickness of said strip.

4. The method of claim 1 wherein said induction coil is operated at a frequency to produce an eddy current penetration depth of about one-half the thickness of said strip and the thickness of delta-one-palisades phase exceeds the thickness of delta-one-compact phase in said zinc/iron alloy coating.

5. The method of claim 1 wherein said frequency is at least 2 kHz.

6. The method of claim 1 wherein said alloy coating includes a thin surface zinc oxide layer, treating said strip to remove said oxide layer whereby said alloy coating is highly receptive to a conversion coating.

7. The method of claim 8 wherein said treatment includes rinsing said strip with an acid from the group consisting of phosphoric and sulphuric to remove said oxide layer.

8. The method of claim 1 including the additional step of treating said coated strip with a phosphate conversion coating.

9. The method of claim 8 including the step of rinsing said coated strip in an acid to remove a thin outer zinc oxide layer on said alloy coating thereby enhancing the phosphating characteristics of said alloy coating.

10. A method of producing a galvannealed steel strip, comprising the steps of:

cleaning a steel strip, electroplating at least one side of the steel strip with a zinc coating, passing said coated strip through an induction coil operating at a frequency less than 10 kHz whereby said coated strip is heated to a temperature no greater than 510° C. to completely convert said zinc coating to a zinc/iron alloy coating by causing iron from the steel strip to diffuse through the entire thickness of said zinc coating, cooling said alloyed strip to substantially stop said diffusion of iron into said zinc/iron alloy coating so that said zinc/iron alloy coating has substantially no zinc alloy gamma phases and said zinc/iron alloy coating has no greater than about 13 atomic % iron, chemically treating said alloyed strip to remove any zinc oxide from the outer surface of said zinc/iron alloy coating whereby said zinc/iron alloy coating is ductile and resistant to cracking.

11. The method of claim 10 wherein said chemical treatment is an acidic solution.

12. A method of producing a galvannealed steel strip, comprising the steps of:

cleaning a steel strip, electroplating the steel strip with a differential weight zinc coating, passing said coated strip through an induction coil operating at a frequency less than 10 kHz whereby said coated strip is heated to a temperature no greater than 510° C. to completely convert said zinc coating on at least one side of said coated strip to a zinc/iron alloy coating by causing iron from the steel strip to diffuse through the entire thickness of said zinc coating, cooling said alloyed strip to substantially stop said diffusion of iron into said zinc/iron alloy coating so that the thickness of any inner layer of zinc alloy gamma phases adjacent to the steel substrate is no greater than about 10% of the total thickness of said zinc/iron alloy coating and the remainder of said zinc/iron alloy coating having no greater than about 13 atomic % iron so that said zinc/iron alloy coating is ductile and resistant to cracking.

13. A method of producing a galvannealed steel strip, comprising the steps of:

cleaning a steel strip, electroplating at least one side of the steel with a zinc coating, passing said coated strip through an induction coil operating at a frequency of at least 2 kHz but less than 10 kHz to heat said coated strip to a temperature less than 510° C. to completely convert said zinc coating to a zinc/iron alloy coating by causing iron from the steel strip to diffuse through the entire thickness of said zinc coating, cooling said alloyed strip within one minute after exiting said induction coil to substantially stop said diffusion of iron into said zinc/iron alloy coating so that said zinc/iron alloy coating has substantially no zinc alloy gamma phases and said zinc/iron alloy coating has no greater than about 13 atomic % iron, chemically treating said alloyed strip with an acidic solution to remove zinc oxide from the outer surface of said zinc/iron alloy coating.

* * * * *